US009714792B2

(12) United States Patent
Sonntag et al.

(10) Patent No.: US 9,714,792 B2
(45) Date of Patent: Jul. 25, 2017

(54) SAGGAR ASSEMBLY

(71) Applicant: IMERYS KILN FURNITURE HUNGARY, Hodmezovasarhely (HU)

(72) Inventors: Andreas Sonntag, Wasserburg am Inn (DE); Sandor Kiss, Hodmezovasarhely (HU)

(73) Assignee: IMERYS KILN FURNITURE HUNGARY, Hódmezövásárhely (HU)

( * ) Notice: Subject to any disclaimer, the term of this patent is extended or adjusted under 35 U.S.C. 154(b) by 54 days.

(21) Appl. No.: 14/631,185

(22) Filed: Feb. 25, 2015

(65) Prior Publication Data

US 2015/0241127 A1 Aug. 27, 2015

(30) Foreign Application Priority Data

Feb. 25, 2014 (DE) ..... 20 2014 100 848 U

(51) Int. Cl.
*F27D 5/00* (2006.01)

(52) U.S. Cl.
CPC ..... *F27D 5/0012* (2013.01); *F27D 5/0006* (2013.01)

(58) Field of Classification Search
CPC ..... F27D 5/0068; C21D 9/0025
USPC ..... 432/81, 258, 261
See application file for complete search history.

(56) References Cited

U.S. PATENT DOCUMENTS 1,336,762 A * 4/1920 Swinnerton ..... F27D 5/0012 432/258
1,384,468 A * 7/1921 Howell ..... F27D 5/0018 432/241
2,453,511 A * 11/1948 Jackson ..... C21D 9/0025 432/261
2,710,746 A * 6/1955 Menough ..... C21D 9/0025 432/261
3,498,597 A * 3/1970 Fritz ..... C21D 9/0025 220/4.01
4,856,990 A * 8/1989 DeSantis ..... F27D 5/005 206/443
6,795,016 B2 * 9/2004 Akiyama ..... B23K 37/0443 432/253
7,740,474 B2 * 6/2010 Scheibel ..... F27D 5/0031 432/258

* cited by examiner

*Primary Examiner* — Gregory A Wilson
(74) *Attorney, Agent, or Firm* — Finnegan, Henderson, Farabow, Garrett & Dunner LLP

(57) ABSTRACT

An assembly for providing a saggar for use in high temperature applications, may include a first substantially rectangular base element and two sets of two substantially rectangular side elements, wherein the side elements of each set of side elements have at least one dimension corresponding to dimensions of first and second opposite edges of the base element. The assembly may also include four corner elements and fasteners, wherein the base element and the side elements are configured to be assembled into a box-shaped saggar and secured to one another using the corner elements and the fasteners, and wherein the first base element is made of a corrosion resistant material.

17 Claims, 7 Drawing Sheets

SAGGAR ASSEMBLY

CLAIM FOR PRIORITY

This application is a U.S. non-provisional application, which claims the benefit of priority of German Patent Application No. DE 20 2014 100 848.9, filed Feb. 25, 2014, the subject matter of which is incorporated herein by reference.

FIELD OF THE INVENTION

The invention concerns assemblies for assembling saggars for use in high temperature treatment, for example, the firing of ceramics, metal, powder calcinations or isolation foam manufacturing.

BACKGROUND OF THE INVENTION

Saggars are ceramic, box-like containers used in the firing of pottery to enclose or protect ware in kilns, or in powder calcinations for holding a powder to be calcined, or in isolation foam manufacturing for carrying the load, or in metal heat treatment. Traditionally, saggars were made primarily from fireclay. Saggars are used to protect or safeguard their load from open flame, smoke, gases and kiln debris. Modern saggars are made of various types of tailored ceramics such as for example alumina ceramics, cordierite ceramics, mullite ceramics, zirconia ceramics, magnesia ceramics, alumina-magnesia spinel ceramics, fused silica ceramics, aluminatitanate ceramics and silicon carbide ceramics.

Traditionally, saggars in commercial use used to comprise rigid rectangular boxes of unitary construction with an open top for receiving green ceramic articles placed therein for subsequent firing. Such saggars were adapted for storing vertically in the kiln for firing. Conventional saggars have a tendency to expand and contract as they are subjected to extreme temperature variations, and they often change shape, making them difficult to stack, or they may even break. It is not economically feasible to repair such saggars.

In many cases, saggars are used in heat treatments involving very rapid heating and cooling, such that high temperature gradients may appear within the saggars, leading to cracking. In the case of box-shaped solids in general, this implies a practicable upper size limit, while larger saggar sizes would be required. Furthermore, corrosion resistance in extreme temperatures is a general problem with saggars.

U.S. Pat. No. 4,008,997 discloses ceramic saggars composed of a square floor section and four identical wall sections, wherein the wall sections each comprise a flange at one end and a flange-receiving socket at an opposite end, as well as a floor supporting flange. The wall sections are assembled in positive locking engagement such that they form a square based volume and the floor section is lowered into the base of the said square. Since the base plate merely rests on the said floor supporting flanges, the assembled saggar is unstable. Furthermore, the appearance of gaps between the base and wall sections is inevitable, making this unsuitable for particulate loads, for example in powder calcinations. Despite the optional presence of gaps between the said flanges and flange-receiving sockets, which are intended to avoid the formation of thermal stresses, this does not solve the problem of upper size limits for the saggars.

The state of the art therefore constitutes a problem.

SHORT DESCRIPTION OF THE INVENTION

The above mentioned drawbacks are overcome by the invention according to the appended claims.

In one embodiment, the invention provides an assembly for providing a saggar, for use in high temperature applications, comprising a first essentially rectangular base element, two sets of two essentially rectangular side elements, the elements of each set having one dimension corresponding to the dimensions of first and second opposite edges of the said base element, four corner elements, and fasteners. According to the said embodiment, the said base element and the said side elements may be assembled into a box-shaped saggar and secured using the said corner elements and the said fasteners. The first base element is made of a corrosion resistant material.

In one embodiment, the assembly further comprises a second base element which is physically strong, such as resistant against thermal shock, physical impact and bending. In an assembled state; the first and second base elements are superimposed such that the first base element faces the load bearing side of the box shaped saggar. The second base element preferably has substantially identical edge dimensions than the first base element. Optionally, the first base element may be thinner than the second base element.

In one embodiment, the side elements and/or the corner elements are also made of a corrosion resistant material.

In one embodiment, the fasteners may be selected from the group ceramic pins, ceramic screws, ceramic glue, or a mixture or a combination thereof.

In one embodiment, the side elements each comprise a rectangular extension at each of the two opposite ends that do not come into contact with the said base elements in an assembled state. In this embodiment, the corner elements each have two recesses facing in directions at a 90 degrees angle to each other for accepting the said rectangular extension of a side element such that they form a positive engagement in an assembled state, and they further each comprise a hole extending in a direction rectangular to the plane of the said base elements in an assembled state. In this embodiment, the first and optional second base elements each comprise four holes arranged in the vicinity of each one of the corners of the essentially rectangular base portions, such that the corner elements and the base elements may be secured to each other using the fasteners of the assembly.

In one embodiment, the assembly is such that in an assembled state, each fastener may be arranged in a hole of each of the first and optional second base elements as well as a whole of each corner element in order to secure the first and optional second base elements and corner elements together.

In one embodiment, the fasteners are ceramic screws and the corner elements further comprise a nut arranged within the hole for threadably securing the ceramic screws within the hole.

In one embodiment, the fasteners are ceramic pins and the corner elements may further comprise means for fixing the said ceramic pins.

In one embodiment, the fasteners comprise a head and the holes in the second base element are chamfered in order to allow space for the head to be embedded in an assembled state.

In one embodiment, the corner elements have extensions at one or both their ends not facing the said side elements in an assembled state, such that the saggars formed in the assembled state become stackable.

In one embodiment, each of the base and side elements may or may not be constituted of separate element portions which in an assembled status may be secured together to form the respective element.

In one embodiment, the holes intended to comprise the fasteners in an assembled state may be filled with a sealant, such as for example a ceramic glue.

In one embodiment, the corrosion resistant material is based on a material selected from $Al_2O_3$, MgO, $Al_2O_3$—MgO-spinel, $ZrO_2$, SiC and combinations of the aforementioned. In a further embodiment, the physically resistant material is based on a material selected from $Al_2O_3$, MgO, $Al_2O_3$—MgO-spinel, $ZrO_2$, SiC, aluminasilicate, cordierite, fused silica and combinations thereof.

In a further embodiment of the present invention, the assembly is for forming a box-shaped saggar suitable for being loaded with goods consisting of corrosive components, such as for example metal oxides or alkali used as base materials in batteries, pigments, or electronic components.

Also part of the present invention is a saggar assembled from the assembly according to the present invention. The saggars according to the invention may be stackable and any intersections between the elements of the assembly may be filled with a sealant, such as for example a ceramic glue.

SHORT DESCRIPTION OF THE FIGURES

The invention is now being described in detail by illustration of embodiments thereof and with reference to the appended figures.

DETAILED DESCRIPTION OF THE INVENTION

Figure 1:
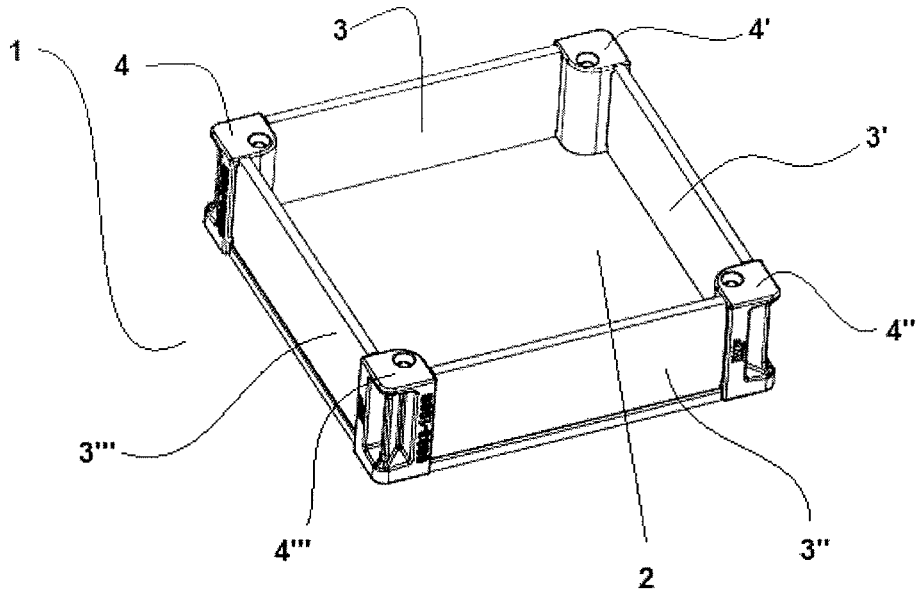
FIG. 1 shows a schematic representation of an assembled box-saggar constituted of the parts of an assembly according to the present invention.

FIG. 1 shows a saggar 1 in an assembled state, as obtained from an assembly according to the present invention. There is a first base element 2 facing the inside of the box-shaped saggar 1. Four side elements 3, 3', 3", 3''' are secured to the first base element 2 using four corner elements 4, 4', 4", 4'''. An optional second base element and screws cannot be seen in this perspective in the assembled state.

Figure 2:
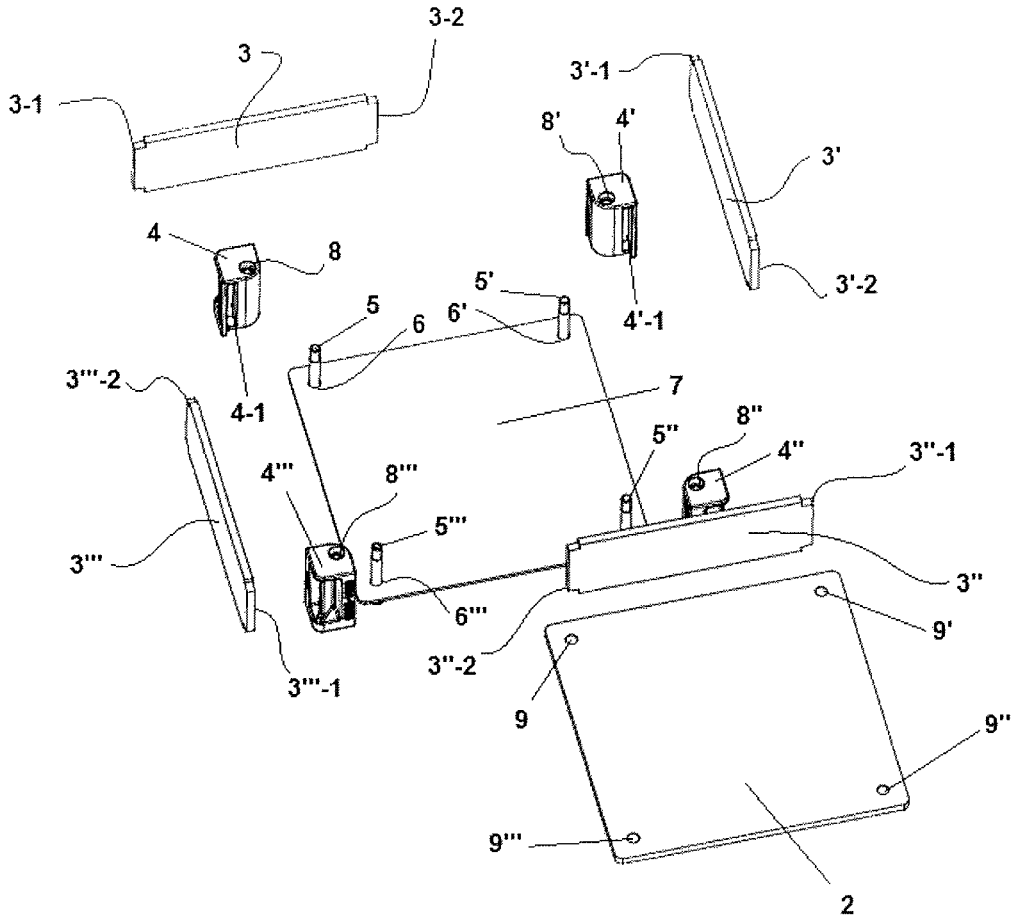
FIG. 2 shows a schematic representation of the separate parts of an assembly according to the present invention.
Figure 3:
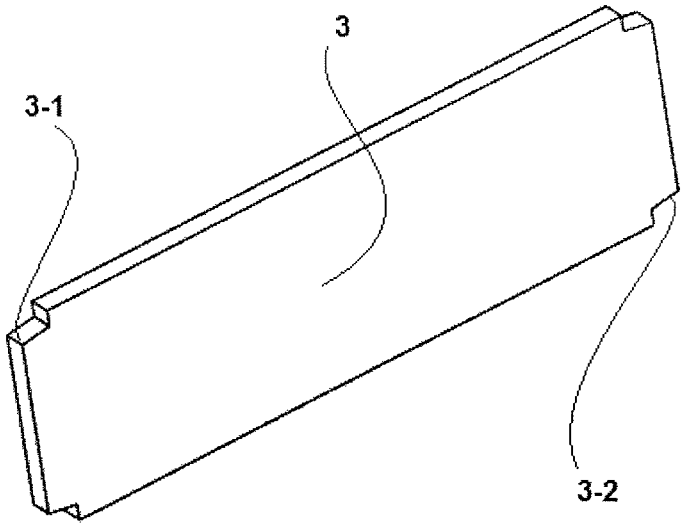
FIG. 3 shows a schematic representation of a side element, which is a part of the assembly according to the present invention.

FIG. 2 shows all the elements of an assembly according to the present invention in a view intended to show one way of assembling the elements of the assembly in order to form a box-shaped saggar 1. Fasteners 5, 5', 5", 5''' have been inserted into holes 6, 6', 6''' located in the vicinity of the corners of the optional second base element 7. The first base element 2, side elements 3, 3', 3", 3''' and corner elements 4, 4', 4", 4''' are also shown. The side elements 3, 3', 3", 3''' each comprise rectangular extensions 3-1, 3-2, 3'-1, 3'-2, 3"-1, 3"-2, 3'''-1, 3'''-2, at each of their two opposite ends that do not come into contact with the said first base element in an assembled state. These are shown more clearly in FIG. 3.

Furthermore in FIG. 2 recesses 4-1, 4'-1 can be seen in the corner elements 4, 4'. All the corner elements shown comprise two recesses oriented facing in directions at a 90 degrees angle to each other, albeit that other recesses cannot be seen due to the perspective chosen. Holes 8, 8', 8", 8''' in the corner elements 4, 4', 4", 4''' are also represented. The first base element 2 comprises four holes 9, 9', 9", 9''' in the vicinity of each of the corners of the first base element 2.

Figure 4:
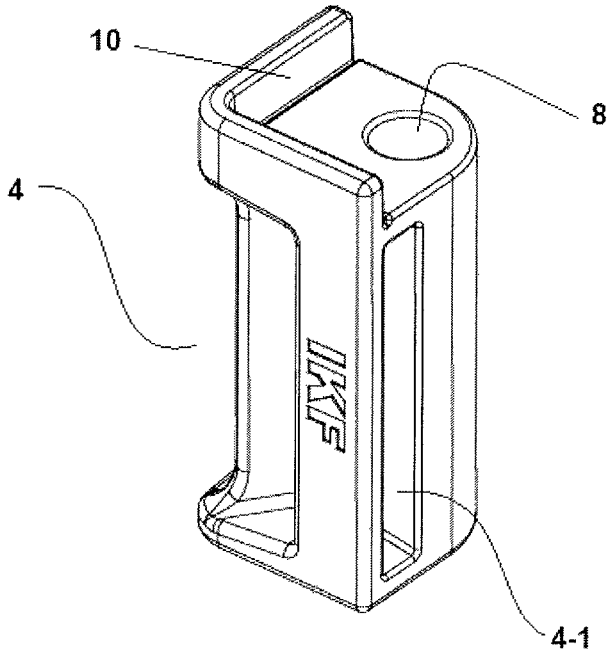
FIG. 4 shows a schematic representation of a corner element, which is a part of the assembly according to the present invention.

FIG. 4 shows a more detailed representation of a corner element 4, with one recess 4-1, and a second recess oriented at 90 degrees to the first recess, pointing into the plane of the paper and therefore not visible. Also visible is hole 8 for accommodating a ceramic screw, as well as an extension 10, which serves as a spacer in the assembled state, such that several assembled box-like saggars may be stacked in use.

Figure 5:
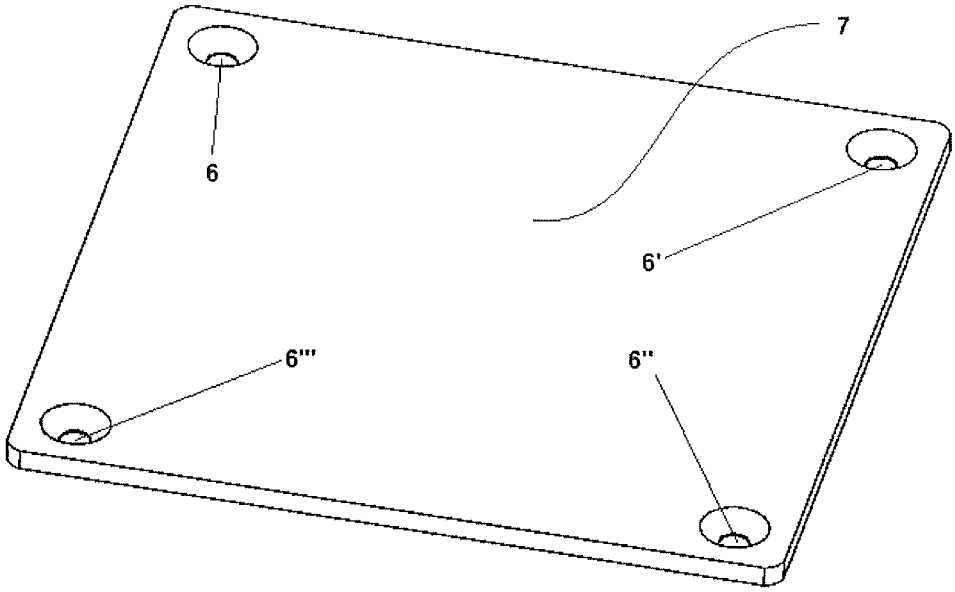
FIG. 5 shows a schematic representation of a second base element, which is a part of the assembly according to the present invention.

FIG. 5 shows a detailed view of a second base element 7, clearly showing that holes 6, 6', 6", 6''' are chamfered in order to accommodate heads of fasteners 5, 5', 5", 5'''. This can also relate to a first base element having chamfered holes in the absence of a second base element.

Figure 6:
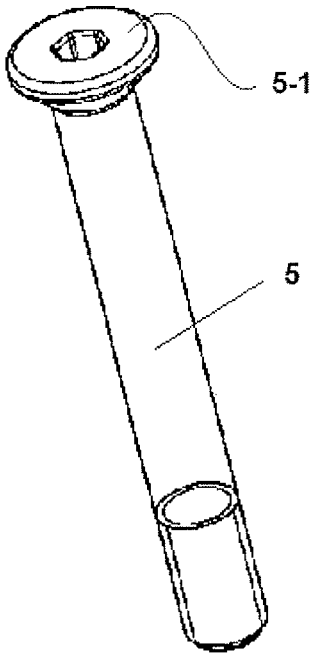
FIG. 6 shows a schematic representation of a screw, which is a part of the assembly according to the present invention.
Figure 7:
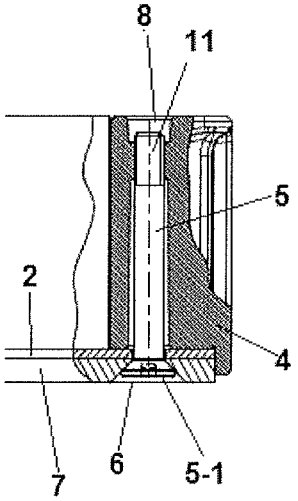
FIG. 7 shows a schematic representation of a cut through a corner element and screw in an assembled state, which is a part of the assembly according to the present invention.

FIG. 6 shows a detailed view of a fastener in the example of a ceramic screw 5 with a head 5-1. FIG. 7 shows a cut through a corner of a box-like saggar assembled form an assembly according to the present invention, wherein there is visible a cut through a corner element 4 with ceramic screw 5, secured using a nut 11 within the hole 8 in the corner element 4. Also shown is a section of a second base element 7 with chamfered hole 6 for accommodating the head 5-1 of ceramic screw 5.

Figure 8:
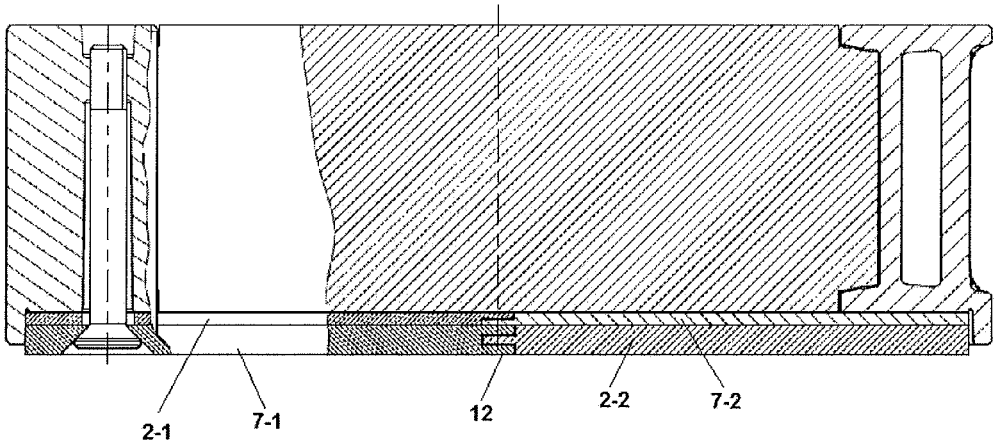
FIG. 8 shows a schematic representation of cut through an assembled box-saggar, showing base elements combined of separate element portions.

FIG. 8 shows a schematic representation of an assembled box-saggar, showing base elements combined of separate element portions 2-1, 2-2, 7-1, 7-2. The base element portions are connected at a connector 12, consisting of cooperating ends of the respective element portions which may form a locking engagement in an assembled state. This arrangement element allows further improved thermal shock resistance of the whole assembly even in case of large overall sizes of a saggar in an assembled state.

According to the present invention, it is possible to provide box-like saggars, wherein the normally competing challenges of obtaining good corrosion resistance and good physical strength, such as impact resistance, thermal shock resistance and bending resistance are simultaneously met. According to the present invention the first base element 2 is an element made of a corrosion resistant material, and which in the assembled state is intended to face towards the interior of the box-like saggar and therefore to come into contact with potentially corrosive loadings. Such corrosive loadings may for example be metal oxides or alkali components used as base materials in batteries, pigments, or electronic components, to mention just a few. Possible corrosion resistant materials for use as or in the material of the first base material are selected from $Al_2O_3$, MgO, $Al_2O_3$—MgO-spinel, $ZrO_2$, SiC and combinations thereof. The drawback of such corrosion resistant materials is that they may have poor performance when it comes to the physical resistance against the adverse conditions experienced by saggars in use. Some important factors are thermal shock resistance, bending resistance and impact resistance.

This is why the assembly according to the present invention may optionally comprise a second base element 7, which has identical or very similar edge dimensions to the first base element 2, such that the first and second base elements 2, 7 may be placed on top of each other and together to form the base of an assembled box-like saggar 1. In order to provide the assembled box-like saggar 1 with the required physical resistance, the said second base element 7 may be relatively thick, which provides added stability to the finished assembled saggar 1. Furthermore, the said second base element 7 may be made of a material that has good physical resistance, such as good thermal shock resistance, good bending resistance and/or good impact resistance. Therefore the second base element 7 may be made of or comprise a material with improved physical properties, such as for example $Al_2O_3$, MgO, $Al_2O_3$—MgO-spinel, $ZrO_2$, SiC, aluminasilicate, cordierite, fused silica or combinations thereof. The second base element 7 may be thicker than the said first base element 2.

The said corner elements (4, 4', 4", 4''') may also be made of or comprise a material with improved physical properties, such as for example $Al_2O_3$, MgO, $Al_2O_3$—MgO-spinel, $ZrO_2$, SiC, aluminasilicate, cordierite, fused silica or combinations thereof.

When assembling a box-like saggar 1 from an assembly according to the present invention, and if a second base element 7 is employed, first and second base elements 2, 7 are placed on top of each other and four fasteners 5, 5', 5", 5''' are inserted through holes 6, 6', 6", 6''', 8, 8', 8", 8''' arranged in the vicinity of the corners of the now superimposed base elements 2, 7. The holes 6, 6', 6", 6''', 8, 8', 8", 8''' are arranged such that when the base elements 2, 7 are placed on top of each other, the holes of each element are also superimposed and it remains possible to insert fasteners 5, 5', 5", 5''' through the said holes. Then, four corner elements 4, 4', 4", 4''' as described above are assembled with four side elements 3, 3', 3", 3''' as described above. These corner and side elements may preferably also be formed of a corrosion resistant material, such as for example the same corrosion resistant material as the said first base element 2. The corner elements 4, 4', 4", 4''' and the side elements 3, 3', 3", 3''' may be assembled by inserting the said extensions 3-1, 3-2, 3'-1, 3'-2, 3"-1, 3"-2, 3'''-1, 3'''-2 of the side elements into the recesses 4-1, 4'-1 of the respective corner elements 4, 4', 4", 4'''.

At this stage, the fasteners 5, 5', 5", 5''' can be inserted into the holes 8, 8', 8", 8''' of the corner elements 4, 4', 4", 4''', therefore connecting the superimposed first and second base elements 2, 7 with the assembled corner elements 4, 4', 4", 4''' and the side elements 3, 3', 3", 3'''. The fasteners 5, 5', 5", 5''' may be ceramic screws, secured to the corner elements 4, 4', 4", 4''' by threadable connection to nuts 11 placed within the holes 8, 8', 8", 8''' in the corner elements 4, 4', 4", 4'''. At this stage, the screws and the corner elements 4, 4', 4", 4''' securely hold together the first and second base elements 2, 7 and the side elements 3, 3', 3", 3''' in order to form a box-like saggar 1 for use for example in kiln firing operations.

In the general case of a box-like saggar 1 without a second base element 7, the assembly is performed in an equivalent way to the above, without the said second base element 7.

Figure 9:
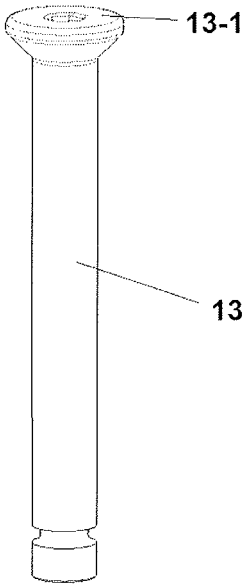
FIG. 9 shows a schematic representation of a fastener in the shape of a ceramic pin.
Figure 10:
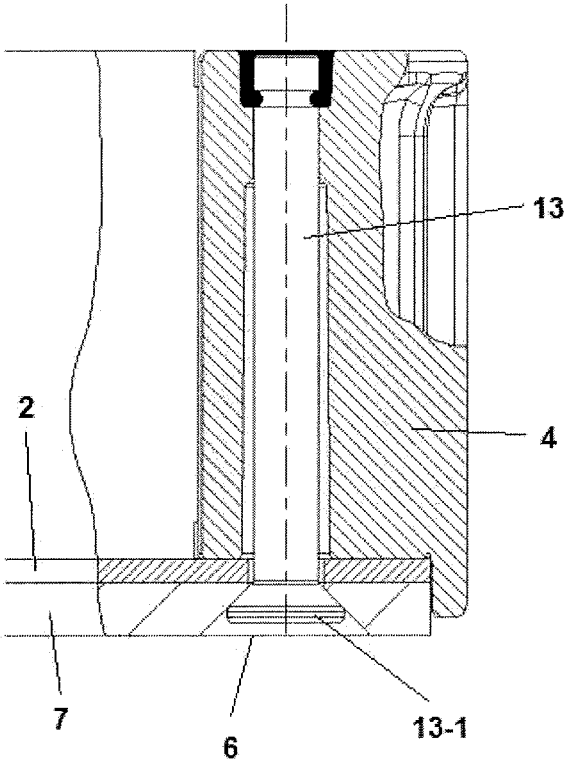
FIG. 10 shows a schematic representation of a cut through a corner element and secured pin in an assembled state, which is a part of the assembly according to the present invention.

The fasteners may also be present in the shape of ceramic pins 13, held in place within the holes 8, 8', 8", 8''' in the corner elements 4, 4', 4", 4''' with ceramic glue or cross pin or other securing means. An exemplary ceramic pin 13 and securing means therefore within corner element 4 is shown in FIGS. 9 and 10. Other fasteners known to the skilled person are also possible. It is also conceivable to fasten the parts together using only ceramic glue as a fastener.

The box-like saggar 1 thus obtained has corrosion resistant internal surfaces, since the first base element 2 is made of a corrosion resistant material as described above. This property is even more pronounced in the case in which also the corner elements 4, 4', 4", 4''' and the side elements 3, 3', 3", 3''' are made of a corrosion resistant material. The secure connection of all the structural elements is obtained through the fasteners 5, 5', 5", 5''' and the corner elements 4, 4', 4", 4''' The connection can be made even more secure by filling any gaps, in particular gap between the fasteners 5, 5', 5", 5''' and the corner elements 4, 4', 4", 4''' within the holes 8, 8', 8", 8''' in the corner elements with a sealant, such as for example a ceramic glue. Also gaps between the side elements 3, 3', 3", 3''' and the first base element 2 or between the side elements 3, 3', 3", 3''' and the corner elements 4, 4', 4", 4''' may be sealed using a sealant such as ceramic glue.

The box-like saggar 1 thus obtained may have improved physical properties due to the optional presence of the said second base element 7, which may be relatively thick, providing added stability to the box-like saggar 1. Furthermore, the optional second base element 7 has improved thermal shock resistance, improved bending resistance and improved impact resistance. Due to the close connection between the first and second base elements 2, 7, the good physical resistance properties of the second base element 7 also protect the said first base element 2 and the box-like saggar 1 as a whole in its assembled state.

With the presence of the extensions 10 at the corner elements 4, 4', 4", 4''', it is rendered possible to stack assembled saggars 1 whilst they are in use, for example in a firing operation in a kiln. This allows to effectively drive multiple assembled saggars 1 through a firing kiln and protects the structural parts of the box-like saggars 1 from damage. In the case of abrasion at the contact points between separate stacked saggars 1, such abrasion occurs at the said extensions of the corner elements 4, 4', 4", 4''' and the base elements 2, 7 and side elements 3, 3', 3", 3''' of the box-like saggars 1 are protected.

In the case of failure of a box-like saggar 1 due to structural damage, the saggar 1 may be disassembled and the undamaged elements may be recycled by reusing them in a separate assembly for forming a box-like saggar 1. Furthermore, the use of assemblies according to the present invention allows the use of larger box-like saggars 1, since the above-described problems regarding thermal shock are alleviated.

It should be noted that the present disclosure includes any combination of the features and/or limitations referred to herein, except for combinations of such features which are mutually exclusive. The foregoing description is directed to particular embodiments of the present invention for the purpose of illustrating it. It will be apparent, however, to one skilled in the art, that many modifications and variations to the embodiments described herein are possible. All such modifications and variations are intended to be within the scope of the present invention, as defined in the appended claims.

REFERENCE SIGNS

1 saggar;
2 first base element;

2-1, 2-2 first base element portions;
3, 3', 3", 3''' side elements;
3-1, 3-2, 3'-1, 3'-2, 3"-1, 3"-2, 3'''-1, 3'''-2 rectangular extensions on side elements;
4, 4', 4", 4''' corner elements;
4-1, 4'-1 recesses in corner elements;
5, 5', 5", 5''' fasteners;
6, 6', 6", 6''' holes in the second base element;
7 second base element;
7-1, 7-2 second base element portions;
8, 8', 8", 8''' holes in the corner elements;
9, 9', 9", 9''' holes in the first base element;
10 extension;
11 nut;
12 connector
13 ceramic pin
13-1 ceramic pin head.

The invention claimed is:

1. An assembly for providing a saggar, the assembly comprising:

a first substantially rectangular base element comprising a corrosion-resistant material;

two sets of two substantially rectangular side elements, wherein the side elements of each set of side elements have at least one dimension corresponding to dimensions of first and second opposite edges of the first base element, and wherein each side element comprises a rectangular extension at each of two opposite ends that do not come into contact with the first base element in an assembled state;

four corner elements, each corner element having two recesses for accepting the rectangular extensions of respective side elements such that the recesses and side elements form a positive engagement in the assembled state, wherein each corner element comprises a hole extending in a direction transverse to a plane of the first base element in the assembled state; and fasteners;

wherein the first base element and the side elements are configured to be assembled into a box-shaped saggar and secured to one another using the corner elements and the fasteners.

2. The assembly according to claim 1, further comprising a second base element comprising a material configured to be at least one of resistant to thermal shock, resistant to physical impact, and resistant to bending, wherein in the assembled form the first and second base elements are superimposed, such that the first base element faces a load bearing side of the base of the saggar.

3. The assembly according to claim 1, wherein the side elements and/or the corner elements comprise a corrosion resistant material.

4. The assembly according to claim 1, wherein the fasteners are selected from the group consisting of ceramic pins, ceramic screws, ceramic glue, or combinations thereof.

5. The assembly according to claim 1, further comprising a second base element, wherein the first base element and the second base element each comprise four holes arranged in a vicinity of respective corners of the first and second base elements, such that the corner elements and the first and second base elements are configured to be secured to each other using the fasteners.

6. The assembly according to claim 5, wherein in an assembled state, each fastener is configured to be arranged in a hole of each of the first and second base elements, as well as a hole of each corner element in order to secure the first and second base elements and corner elements together.

7. The assembly according to claim 5, wherein the fasteners comprise ceramic screws, and each corner element further comprises a nut arranged within a respective hole of the first base element or the second base element, such that each hole threadably receives a respective ceramic screw.

8. The assembly according to claim 5, wherein the fasteners comprise ceramic pins, and the corner elements further comprise a coupling configured to fix the ceramic pins.

9. The assembly according to claim 1, further comprising a second base element, wherein each fastener includes a head, and the holes in the first base element and the second base element are chamfered in order to allow space for a respective head of a fastener to be embedded in the assembled state.

10. The assembly according to claim 1, wherein the corner elements include extensions at one or both ends not facing the side elements in the assembled state, such that the saggar formed in the assembled state is stackable.

11. The assembly according to claim 1, further comprising a second base element, wherein each of the first base element, the second base element, and the side elements are configured to be assembled to form the box-shaped saggar.

12. The assembly according to claim 1, wherein the corner elements comprise holes configured to receive the fasteners, and wherein the holes in the assembled state are configured to receive a sealant.

13. The assembly according to claim 1, wherein the corrosion resistant material comprises a material selected from $Al_2O_3$, MgO, $Al_2O_3$—MgO-spinel, $ZrO_2$, SiC and combinations thereof.

14. The assembly according to claim 1, further comprising a second base element made of a material configured to be at least one of resistant to thermal shock, resistant to physical impact, and resistant to bending, and wherein the material comprises a material selected from $Al_2O_3$, MgO, $Al_2O_3$—MgO-spinel, $ZrO_2$, SiC, aluminasilicate, cordierite, fused silica, and combinations thereof.

15. The assembly according to claim 1 wherein the assembly is configured to receive goods comprising corrosive components including at least one of metal oxides and metal alkali used as base materials in batteries, pigments, or electronic components.

16. A box-shaped saggar comprising the assembly according to claim 1.

17. An assembly for providing a saggar for use in high temperature applications, the assembly comprising:

a first substantially rectangular base element comprising a corrosion-resistant material;

a second base element;

two sets of two substantially rectangular side elements, wherein the side elements of each set of side elements have at least one dimension corresponding to dimensions of first and second opposite edges of the first base element, and wherein each side element comprises a rectangular extension at each of two opposite ends that do not come into contact with the first base element in an assembled state;

four corner elements, each corner element having two recesses facing in directions transverse with respect to one another for accepting the rectangular extension of a respective side element such that they form a positive engagement in the assembled state, wherein each corner element comprises a hole extending in a direction transverse to a plane of the first base element in the assembled state; and fasteners;

wherein the first base element, the second base element, and the side elements are configured to be assembled into a box-shaped saggar, the first base element and the second base element each comprising four holes arranged in a vicinity of each corner of the respective first and second base elements, such that the corner elements and the first and second base elements are configured to be secured to each other using the fasteners.

* * * * *